US008324791B2

(12) United States Patent
Kameda et al.

(10) Patent No.: US 8,324,791 B2
(45) Date of Patent: Dec. 4, 2012

(54) SPARK PLUG FOR INTERNAL COMBUSTION ENGINE

(75) Inventors: Hiroyuki Kameda, Aichi (JP); Mamoru Musasa, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 305 days.

(21) Appl. No.: 12/274,396

(22) Filed: Nov. 20, 2008

(65) Prior Publication Data

US 2009/0127997 A1 May 21, 2009

(30) Foreign Application Priority Data

Nov. 20, 2007 (JP) ..... P2007-300824

(51) Int. Cl.
*H01T 13/26* (2006.01)
*H01T 21/02* (2006.01)

(52) U.S. Cl. ..... 313/141; 123/169 R

(58) Field of Classification Search ..... 313/141–145, 313/128, 118, 140, 147; 123/169 R
See application file for complete search history.

(56) References Cited

U.S. PATENT DOCUMENTS

| | | | | |
|---|---|---|---|---|
| 4,514,657 | A * | 4/1985 | Igashira et al. | 313/130 |
| 4,700,103 | A | 10/1987 | Yamaguchi et al. | |
| 5,488,262 | A | 1/1996 | Takamura | |
| 6,720,716 | B2 | 4/2004 | Shibata et al. | |
| 6,724,132 | B2 | 4/2004 | Kanao | |
| 6,798,124 | B2 | 9/2004 | Hiramatsu | |
| 7,084,558 | B2 | 8/2006 | Teramura et al. | |
| 7,321,187 | B2 | 1/2008 | Teramura et al. | |
| 2002/0021066 | A1 | 2/2002 | Kanao | |
| 2002/0050775 | A1 | 5/2002 | Hori | |
| 2002/0093277 | A1 | 7/2002 | Hiramatsu | |
| 2004/0041506 | A1 | 3/2004 | Teramura et al. | |
| 2004/0092193 | A1 | 5/2004 | Musasa et al. | |
| 2006/0238092 | A1 | 10/2006 | Teramura et al. | |

FOREIGN PATENT DOCUMENTS

| | | | |
|---|---|---|---|
| JP | 61-45583 | A | 3/1986 |
| JP | 5-166577 | A | 7/1993 |
| JP | 5-198348 | A | 8/1993 |
| JP | 7-22157 | A | 1/1995 |
| JP | 8-213149 | A | 8/1996 |
| JP | 2002-33176 | A | 1/2002 |
| JP | 2002-83662 | A | 3/2002 |
| JP | 2002-289321 | A | 10/2002 |
| JP | 2002-324650 | A | 11/2002 |
| JP | 2004-127916 | A | 4/2004 |
| WO | 02065604 | A1 | 8/2002 |

* cited by examiner

*Primary Examiner* — Anh T. Mai
*Assistant Examiner* — Elmito Breval
(74) *Attorney, Agent, or Firm* — Sughrue Mion, PLLC

(57) ABSTRACT

A spark plug including: a rod-shaped center electrode; an insulator; a metal shell; a ground electrode joined to the metal shell and bent toward the center electrode; a noble metal tip joined to an end portion of the ground electrode and opposing a leading end portion of the center electrode via a gap; and a bulge portion. A part of the noble metal tip is embedded in the ground electrode, and another part of the noble metal tip protrudes from a distal end surface of the ground electrode. A relationship A≧0.25 mm is satisfied where A (mm) is a protruding length of the noble metal tip from the distal end surface. The bulge portion covers a center part of a boundary between the noble metal tip and the end surface in a width direction.

15 Claims, 13 Drawing Sheets

SPARK PLUG FOR INTERNAL COMBUSTION ENGINE

BACKGROUND OF THE INVENTION

1. Field of the Invention

The present invention relates to a spark plug used for an internal combustion engine.

2. Description of the Related Art

A spark plug used for an internal combustion engine, such as an automobile engine, includes a center electrode extending in a direction of an axial line thereof, an insulator disposed radially outside the center electrode, a cylindrical metal shell disposed radially outside the insulator, and a ground electrode having a base end portion joined to a leading end surface of the metal shell. The ground electrode has a substantially rectangular shape in cross section, and the inner surface of the leading end portion thereof is disposed to face the leading end portion of the center electrode. As a result, a spark discharge gap is defined between the leading end portion of the center electrode and the leading end portion of the ground electrode.

In recent years, tips (noble metal tips) containing a noble metal alloy have been attached to the leading end portion of the center electrode and the leading end portion of the ground electrode, respectively. Attaching the noble metal tips improves spark wear resistance. Particularly, a prism-shaped noble metal tip is welded to an axial-side tip surface of the ground electrode and protrudes toward the axial line of the center electrode in order to improve ignitability or spark propagation capability (see JP-A-61-45583 and JP-A-2002-324650, for example).

However, if the noble metal tip protrudes from the second end surface of the ground electrode toward the axial line as mentioned above, the protruding end portion of the noble metal tip is located apart from a base material of the ground electrode. Consequently, heat dissipation property (heat conductance from the ground electrode to the metal shell) will become unsatisfactory, and a higher temperature will be easily reached. Particularly in engines used in recent years, combustion temperature has increased, and, as a result, the leading end portion of the ground electrode is outwardly exposed to higher temperatures.

In this state, the noble metal tip and the ground electrode repeatedly thermally expand and shrink. Further, due to a dimensional difference in thermal expansion and shrinkage between these two elements, a stress difference occurs in the boundary between the noble metal tip and the ground electrode when viewed from the distal end surface of the ground electrode. As a result, the ground electrode and noble metal tip are subject to deformation or distortion. Therefore, oxygen readily invades from the boundary, and an oxide scale is liable to be formed thereon. Therefore, oxidation resistance and peel resistance may be reduced due to the oxide scale formed in the welded portion.

SUMMARY OF THE INVENTION

The present invention was made in consideration of the above circumstances, and an object thereof is to provide a spark plug for an internal combustion engine capable of improving ignitability and flame propagation capability and preventing a decrease in peel resistance due to the oxide scale.

The above objects of the invention have been achieved in accordance with the following.

(1) In a first aspect, the invention provides a spark plug for an internal combustion engine, comprising: a rod-shaped center electrode extending from a leading end thereof to a base end thereof in an axial direction; a substantially cylindrical insulator disposed on an outer periphery of the center electrode and extending from a leading end thereof to a base end thereof in the axial direction; a substantially cylindrical metal shell disposed on an outer periphery of the insulator and extending from a leading end thereof to a base end thereof in the axial direction; a ground electrode comprising a basal end portion joined to a leading end surface of the metal shell and a distal end portion bent toward the center electrode; a first noble metal tip joined to the distal end portion of the ground electrode and opposing a leading end portion of the center electrode so as to define a gap, a part of the first noble metal tip being embedded in the ground electrode, and another part of the first noble metal tip protruding in a protruding direction from a distal end surface of the distal end portion of the ground electrode such that a relationship $A \geqq 0.25$ mm is satisfied where A (mm) is the protruding length of the first noble metal tip from the distal end surface of the distal end portion of the ground electrode; and a bulge portion covering at least a center part of the first noble metal tip in a width direction at a boundary between the first noble metal tip and the distal end surface of the ground electrode In a preferred embodiment, the bulge portion contains a metallic material the same as that contained in the ground electrode.

According to the first aspect, the noble metal tip protrudes from the distal end surface of the ground electrode, and the relationship $A \geqq 0.25$ mm is satisfied where A (mm) is the protruding length therefrom. As a result, spark wear resistance as well as ignitability and spark propagation capability can be improved.

On the other hand, the protruding end portion of the noble metal tip can easily reach a high temperature. The boundary between the noble metal tip and the ground electrode (when viewed from the distal end surface of the ground electrode) is subject to a stress difference, and, as a result, deformation or distortion can readily occur. Therefore, oxygen may invade from the boundary. Especially when the relationship $A \geqq 0.25$ mm is satisfied as described above, the tendency of peeling-off (falling-off of the tip) resulting from the formation of an oxide scale is further increased. However, in a preferred embodiment of the first aspect, the bulge portion containing a metallic material the same as that contained in the ground electrode is provided at the boundary extending in the width direction between the noble metal tip and the distal end surface of the ground electrode so as to cover at least a center part of the noble metal tip therewith. Therefore, the bulge portion having a predetermined thickness closes the gap between the noble metal tip and the ground electrode, and functions as a barrier against oxygen invasion. Therefore, the formation of an oxide scale resulting from oxygen invasion from the boundary can be controlled. Additionally, the bulge portion also functions as a stress reducing layer between the noble metal tip and the ground electrode. The synergistic effect of these functions can effectively enhance the peel resistance of the noble metal tip.

In particular, the bulge portion is disposed so as to cover at least a center part of the noble metal tip (the center part in the width direction) at the boundary. Hence, even if there is an area having no bulge portion, this exposed area will be comparatively narrower than a case in which the bulge portion is disposed at an edge of the noble metal tip. Therefore, oxygen invasion can be prevented more effectively and easily.

(2) In a second aspect, the invention provides a spark plug of the first aspect, wherein a relationship $E/B \geqq 0.5$ is satisfied where B (mm) is a width of the first noble metal tip, E1 (mm) is a length of the bulge portion on a line extending in the width direction and deviating by 0.05 mm from the boundary in the axial direction, E2 (mm) is a length of the bulge portion on a line extending in the width direction and deviating by 0.05 mm from the boundary in a protruding direction, and E (mm) is the shorter of lengths E1 and E2.

According to the second aspect, the bulge portion is not merely a thin portion located at the boundary, and has a predetermined volume.

In other words, in the second aspect, the size in the width direction of the bulge portion occupies more than half the noble metal tip in the width direction even at positions deviating in the direction of the axis line and in the protruding direction, respectively, from the boundary extending in the width direction. As a result, oxygen invasion can be more reliably prevented, and the operation and effect of the spark plug of the first aspect can be more reliably realized.

The direction of electric discharge in the spark plug is not limited in the first and second aspects of the invention. However, the direction of the electric discharge may be as defined in third, fourth and fifth aspects, or a sixth aspect, explained below.

(3) In a third aspect, the present invention provides a spark plug of the first or second aspect, wherein a protruding end surface of the first noble metal tip in the protruding direction opposes the leading end portion of the center electrode to allow spark discharge in a direction substantially perpendicular to the axial direction.

(4) In a fourth aspect, the present invention provides a spark plug of the third aspect, wherein a relationship $F \geqq 0.1\,G$ is satisfied where F (mm) is a distance between a protruding end of the bulge portion in the protruding direction and the protruding end surface of the first noble metal tip, and G (mm) is a shortest distance of the gap.

(5) In a fifth aspect, the present invention provides the spark plug of the third or fourth aspect, wherein the center electrode comprises a center electrode main body and a second noble metal tip joined to a leading end portion of the center electrode main body, wherein the center electrode main body and the second noble metal tip are joined to each other via a molten bond in which metallic components of the center electrode main body and the second noble metal tip are fused, wherein the gap is provided between an outer circumferential surface of the second noble metal tip and the protruding end surface of the first noble metal tip, and wherein a relationship $H \geqq 1.05 \times G$ is satisfied where H (mm) is a shortest distance between the first noble metal tip and the molten bond, and G (mm) is a shortest distance of the gap.

Accordingly, the first and second aspects can be realized in a type of spark plug in which spark discharge is carried out in a horizontal direction as in the third through fifth aspects. As a result, flame propagation capability can be further improved.

Especially in the fourth aspect, the relationship $F \geqq 0.1\,G$ is satisfied where F (mm) is a distance between a protruding end of the bulge portion in the protruding direction and the protruding end surface of the noble metal tip, and G (mm) is a shortest distance of the gap (for spark discharge). Therefore, spark discharge is more reliably carried out between the noble metal tip and the leading end portion of the center electrode. In other words, spark discharge is restrained between the bulge portion and the leading end portion of the center electrode. Consequently, by restraining spark erosion of the bulge portion, the bulge portion can be maintained for a longer time, and the effect of preventing peeling-off of the noble metal tip can be maintained for a longer time.

Additionally, in the type of spark plug in which a spark discharge is carried out in the horizontal direction as described above, if a molten bond formed by welding the noble metal tip for the center electrode to the leading end of the center electrode is present as in the fifth aspect, spark discharge may occur between the molten bond and the noble metal tip. Concerning this respect, in the fifth aspect, the relationship $H \geqq 1.05 \times G$ is satisfied where H (mm) is a shortest distance between the noble metal tip and the molten bond, and G (mm) is a shortest distance of the gap. Therefore, the sparking rate between the molten bond and the noble metal tip can be extremely low. Also, defects resulting from spark discharge occurring between the molten bond and the noble metal tip, such as falling-off of the noble metal tip for the center electrode, can be more reliably prevented.

(6) In a sixth aspect, the present invention provides a spark plug of the first or second aspect, wherein a base end surface of the first noble metal tip opposes the leading end portion of the center electrode in the axial direction to allow spark discharge substantially in the axial direction.

More preferably, in particular, the following seventh, eighth and ninth aspects may be adopted.

(7) In a seventh aspect, the present invention provides a spark plug of any one of the first to sixth aspects, wherein a leading end surface of the first noble metal tip is positioned on a leading end side in the axial direction farther than a leading end of the center electrode.

In the seventh aspect, the bulge portion is located in the leading end side farther than the leading end surface of the center electrode, and hence can more reliably restrain spark discharge occurring between the bulge portion and the center electrode. As a result, erosion of the bulge portion can be easily prevented.

(8) In an eighth aspect, the present invention provides a spark plug of any one of the first to seventh aspects, wherein a width of the first noble metal tip is greater than a diameter or a width of the leading end portion of the center electrode.

The spark plug of the eighth aspect restrains a spark discharge occurring between the leading end portion of the center electrode and a part of the ground electrode differing from the noble metal tip. In other words, normal spark discharge between the noble metal tips can be achieved more reliably.

(9) In a ninth aspect, the present invention provides a spark plug any one of the first to seventh aspects, wherein the first noble metal tip has a prism shape.

Adopting a prism-shaped noble metal tip as in the ninth aspect promotes spark discharge at an edge portion, and makes it possible to more reliably achieve normal spark discharge at the noble metal tip.

In the spark plug of each aspect, a method of joining the first noble metal tip to the ground electrode is not limited, but the following aspect can also be adopted.

(10) In a tenth aspect, the present invention provides a spark plug of any one of the first to ninth aspects, wherein the first noble metal tip is joined to the ground electrode by resistance-welding.

Because only a part of the first noble metal tip is embedded in the ground electrode as in each aspect, the joining work may be difficult to carry out by laser beam welding or electron beam welding. Therefore, the joining work can be carried out comparatively smoothly by joining the first noble metal tip to the distal end portion of the ground electrode by resistance-welding as in the tenth aspect.

The spark plug of each aspect described above can be produced as follows.

(11) In an eleventh aspect, the present invention provides a method for producing a spark plug of any one of the first to tenth aspects, said method comprising joining the first noble metal tip to the ground electrode by resistance welding while pressing the first noble metal tip against a flat surface of the ground electrode adjacent the distal end surface, such that the noble metal tip is embedded a length of 0.3 mm or more from the flat surface, thereby forcing a component of the ground electrode to protrude at the boundary and form the bulge portion.

The method of the eleventh aspect can save the time-consuming job of newly providing a bulge portion at the boundary. In other words, when the first noble metal tip is joined to the distal end portion of the ground electrode by resistance-welding, the noble metal tip is embedded a length of 0.3 mm or more which is a comparatively large amount, and a structural component of the ground electrode protrudes at the boundary. As a result, a bulge portion is formed. Therefore, an increase in the number of worker hours or an increase in cost, etc., can be prevented.

DESCRIPTION OF THE EMBODIMENTS

Figure 1:
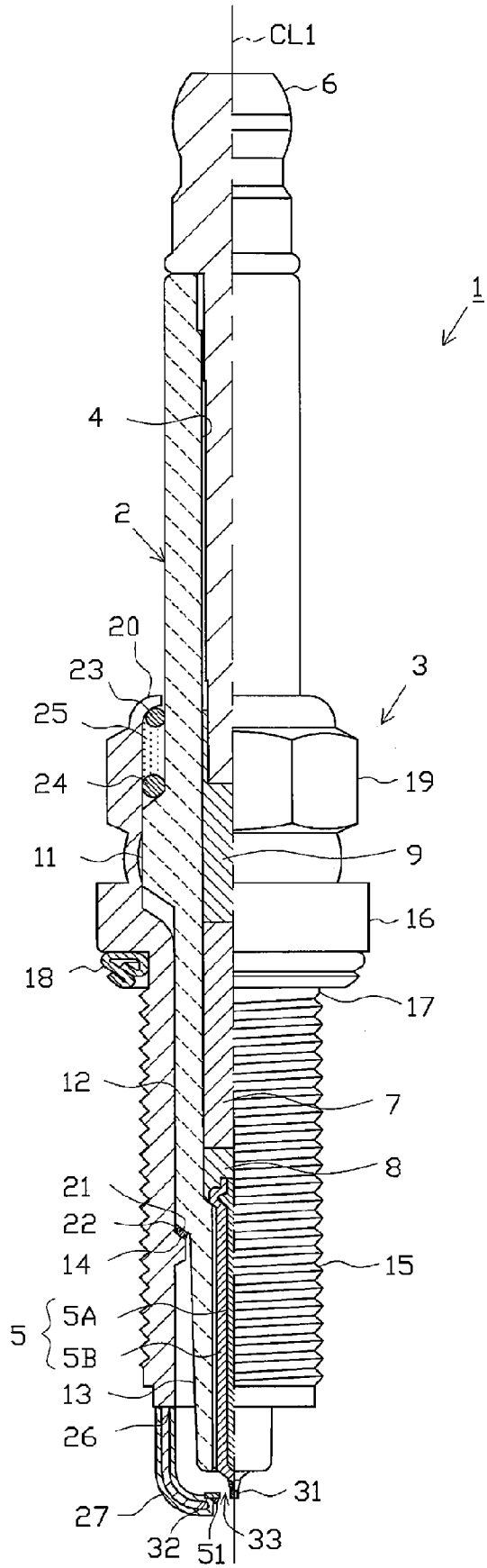
FIG. 1 is a partial sectional front view illustrating the structure of a spark plug of the present embodiment.

An embodiment of the present invention is next described with reference to the drawings. However, the present invention should not be construed as being limited thereto. FIG. 1 is a partial sectional view of a spark plug 1. In the description, a direction of an axis line CL1 of the spark plug 1 (also referred to as an axial direction) corresponds to a vertical direction in FIG. 1. In addition a lower side in FIG. 1 corresponds to a leading end side of the spark plug 1, and an upper side in FIG. 1 corresponds to a base end side of the spark plug 1.

The spark plug 1 includes an insulator 2 serving as an insulating material and a cylindrical metal shell 3 holding the insulator 2.

The insulator 2 has an axial hole 4 penetrating therethrough along the axis line CL1. A center electrode 5 is inserted and fixed to the leading end portion of the axial hole 4, whereas a terminal electrode 6 is inserted and fixed to the base end portion thereof A resistor 7 is disposed between the center electrode 5 and the terminal electrode 6 in the axial hole 4. Both ends of the resistor 7 are electrically connected to the center electrode 5 and the terminal electrode 6 via electrically-conductive glass seal layers 8 and 9, respectively.

The center electrode 5 is fixed to protrude from the leading end of the insulator 2, and the terminal electrode 6 is fixed so as to protrude from the base end of the insulator 2. A noble metal tip (noble metal tip for a center electrode) 31 containing iridium as a main component is joined to the leading end of the center electrode 5 by welding.

On the other hand, the insulator 2 is formed by sintering alumina or the like, and has an outer shape including a flange-shaped large diameter portion 11 that protrudes radially-outwardly at a substantially center portion in the direction of the axis line CL1, an intermediate barrel portion 12 disposed on the leading end side that is smaller in diameter than the large diameter portion 11, and a leg portion 13 disposed on the leading end side that is smaller in diameter than the intermediate barrel portion 12 and that is exposed to the combustion chamber of an internal combustion engine. A leading end portion of the insulator 2, which includes the large diameter portion 11, the intermediate barrel portion 12 and the leg portion 13, is housed in the cylindrical metal shell 3. A step portion 14 is formed at the connection part between the leg portion 13 and the intermediate barrel portion 12, and firmly engages the insulator 2 with the metal shell 3.

The metal shell 3 contains metal, such as low-carbon steel, and is formed in a cylindrical shape. The metal shell 3 has an outer circumferential surface provided with a threaded portion 15 (male screw portion) used to attach the spark plug 1 to a cylinder head of the engine. A seat portion 16 is formed on the outer circumferential surface on the base end side of the threaded portion 15. A ring-shaped gasket 18 is fitted to a screw neck 17 formed at the base end of the threaded portion 15. A tool-engaging portion 19 having a hexagonal cross section used to engage a tool, such as a wrench, when the metal shell 3 is attached to the cylinder head, is disposed on the base end side of the metal shell 3. Additionally, a crimping portion 20 used to hold the insulator 2 at its base end portion is disposed on the base end side of the metal shell 3.

The metal shell 3 has an inner circumferential surface provided with a step portion 21 used to engage the insulator 2. The insulator 2 is inserted from the base end side toward the leading end side of the metal shell 3, and the step portion 14 thereof is firmly engaged with the step portion 21 of the metal shell 3. In this state, an opening on the base end side of the metal shell 3 is tightened radially inwardly, i.e., the crimping portion 20 is formed, and, as a result, the insulator 2 is firmly fixed. An annular plate packing 22 is interposed between the step portion 14 of the insulator 2 and the step portion 21 of the metal shell 3. Accordingly, the airtightness of the combustion chamber is maintained, so that fuel air that enters a gap between the leg portion 13 of the insulator 2 exposed to the combustion chamber and the inner circumferential surface of the metal shell 3 cannot leak outwardly.

Additionally, to more completely seal by crimping, annular ring members 23 and 24 are interposed between the metal shell 3 and the insulator 2 on the base end side of the metal shell 3, and the gap between the ring members 23 and 24 is filled with talc powder 25. In other words, the metal shell 3 holds the insulator 2 by means of the plate packing 22, the ring members 23 and 24, and the talc powder 25.

Ground electrode 27 has a substantially L-shape in cross section and is joined to the leading end surface 26 of the metal shell 3. More specifically, the ground electrode 27 includes a base end portion welded to the leading end surface 26 of the metal shell 3, and a distal end portion bent toward the side of the axis line CL1 so that a distal end surface of the distal end portion can almost exactly face the outer circumferential surface of the noble metal tip 31 for the center electrode. In the present embodiment, the ground electrode 27 is provided with the noble metal tip 32 disposed so as to face the noble metal tip 31 for the center electrode. In more detail, the noble metal tip 32 is welded to the ground electrode 27 such that a part of the noble metal tip 32 is embedded therein, and another part of the noble metal tip 32 protrudes from the distal end surface 27*s* on the side of the axis line CL1 of the ground electrode 27 toward the axis line CL1 (see FIG. 2). The gap between the noble metal tips 31 and 32 serves as a spark discharge gap 33. Therefore, in the present embodiment, a spark discharge occurs in a direction substantially perpendicular to the direction of the axis line CL1.

Figure 2:
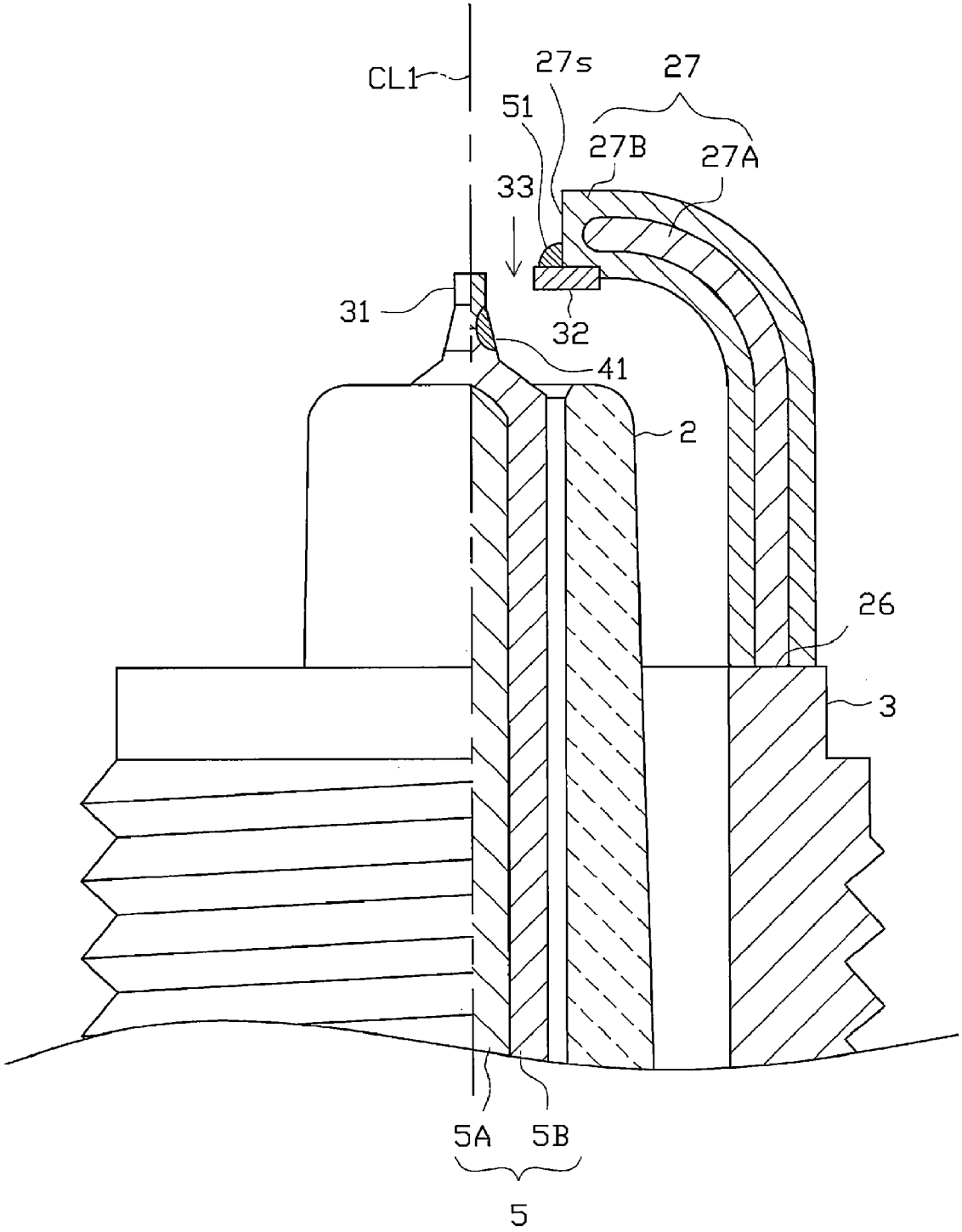
FIG. 2 is a partially enlarged sectional view of the spark plug.

As shown in FIG. 2, the center electrode 5 includes an inner layer 5A containing copper or a copper alloy and an outer layer 5B containing a nickel (Ni) alloy. The center electrode 5 includes a leading end portion of reduced diameter, has a rod-shaped (cylindrical) shape as a whole, and has a leading end surface formed flat. The cylindrical noble metal tip 31 for the center electrode is laid on the leading end surface of the center electrode, and the outer edge of the resulting joint area is subjected to laser beam welding or electron beam welding, etc. As a result, the noble metal tip 31 for the center electrode and the center electrode 5 are fused, and a molten bond 41 is formed. In other words, the noble metal tip 31 for the center electrode is fixedly joined to the leading end of the center electrode 5 by the molten bond 41.

On the other hand, the ground electrode 27 has a two-layer structure including an inner layer 27A and an outer layer 27B. The outer layer 27B in the present embodiment contains a nickel alloy, such as INCONEL (trade name) 600 or 601, whereas the inner layer 27A contains a nickel alloy or pure copper superior in thermal conductivity to the above-mentioned nickel alloy. The inner layer 27A improves the heat dissipation property. In the present embodiment, the ground electrode 27 has a substantially rectangular shape in cross section.

As described above, the noble metal tip 31 for the center electrode disposed on the side of the center electrode 5 contains iridium as a main component, whereas the noble metal tip 32 disposed on the side of the ground electrode 27 contains a noble metal alloy containing rhodium in an amount of 20 mass % and a main component such as platinum. However, these material compositions are mentioned as an example, but the invention is not limited thereto. For example, the noble metal tips 31 and 32 may be produced as follows. First, an ingot containing iridium or platinum as a main component is prepared, respective alloying elements are then mixed and melted to form the predetermined composition mentioned above, an ingot is then again formed from the melted alloy, and this second ingot is subjected to hot forging and hot rolling (groove rolling). Thereafter, the alloy thus processed is subjected to wire drawing, and, as a result, a rod-shaped material is obtained. Thereafter, the rod-shaped material is cut to have a predetermined length, and, as a result, the cylindrical noble metal tip 31 for the center electrode and the prism-shaped noble metal tip 32 are obtained.

As described above, the noble metal tip 32 protrudes from the distal end surface 27*s* of the ground electrode 27 toward the axis line CL1. Especially in the present embodiment, the noble metal tip 32 is resistance welded to the ground electrode 27 so that a part of the noble metal tip 32 is buried therein as shown in FIGS. 3, 4, 5A, and 5B, and the relationship $A \geqq 0.25$ mm is satisfied where A (mm) is the protruding length of the noble metal tip 32 from the distal end surface 27*s*. A bulge portion 51 containing the same nickel alloy as the outer layer 27B of the ground electrode 27 is disposed at a boundary D extending in the width direction between the noble metal tip 32 and the distal end surface 27*s* of the ground electrode 27 so as to cover at least a center part of the noble metal tip 32 (see FIG. 5A and FIG. 5B, for example). The bulge portion 51 will be described in more detail. The bulge portion 51 satisfies the relationship $E/B \geqq 0.5$ where B (mm) is the width of the noble metal tip 32, E1 (mm) is the length of the bulge portion 51 on a line extending in the width direction and deviating by 0.05 mm from the boundary in the axial direction, E2 (mm) is the length of the bulge portion 51 on a line extending in the width direction and deviating by 0.05 mm from the boundary D in a protruding direction, and E (mm) is the shorter of the lengths E1 and E2. That is, the comparatively thick bulge portion 51 is sufficiently voluminous to cover at least a center part of the boundary D in the width direction with the bulge portion 51.

Figure 3:
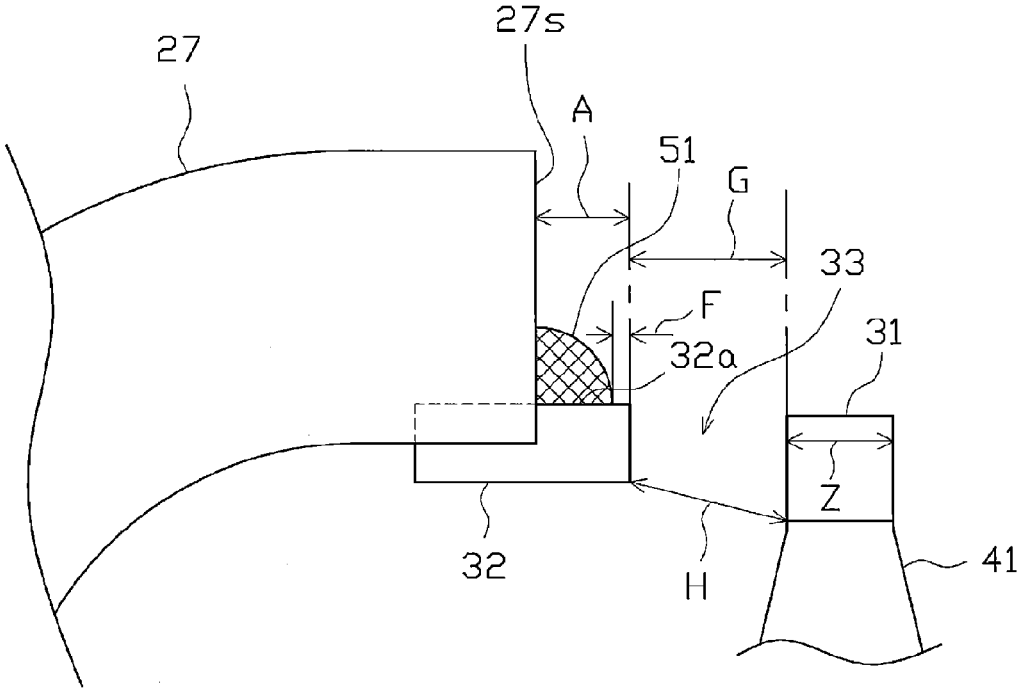
FIG. 3 is an enlarged schematic view of a main part.
Figure 4:
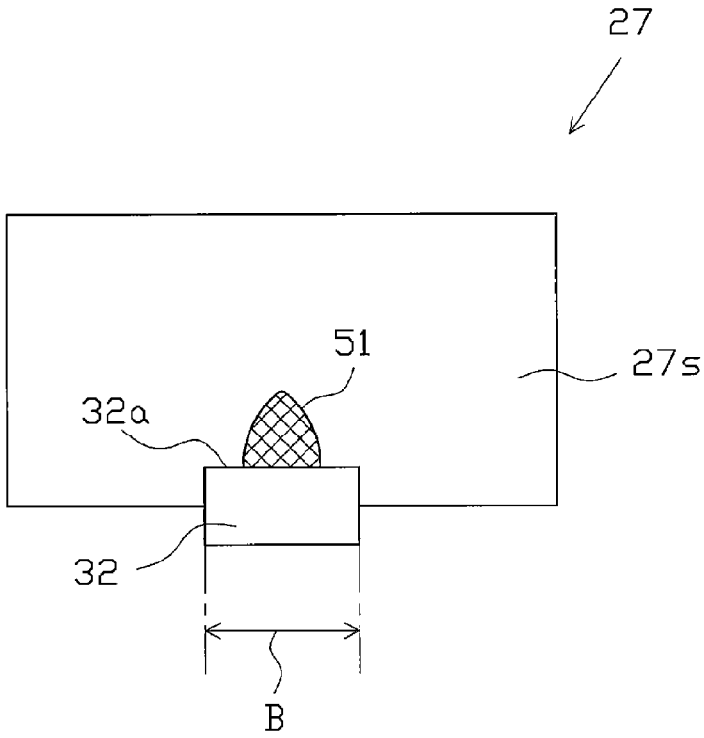
FIG. 4 is a side view of a ground electrode when viewed from a direction perpendicular to FIG. 3.
Figure 5A:
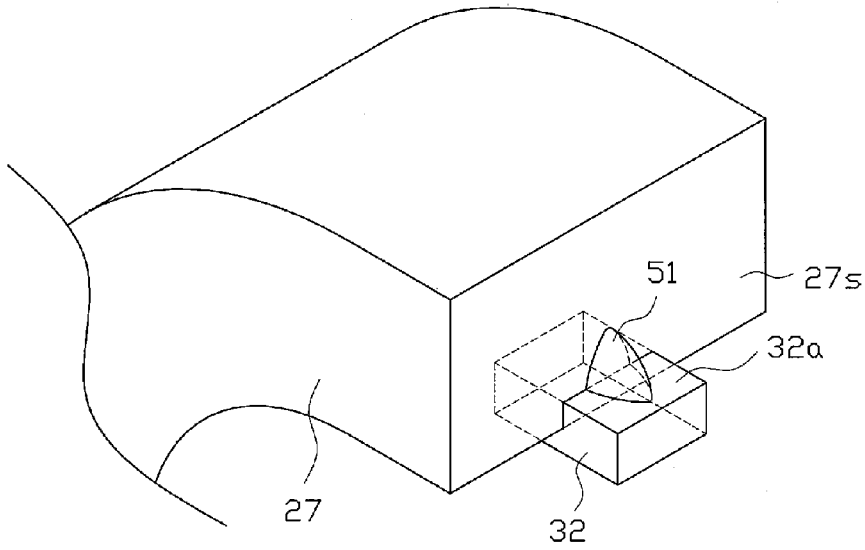
FIG. 5A is a perspective view of a main part of the distal end of the ground electrode.
Figure 5B:
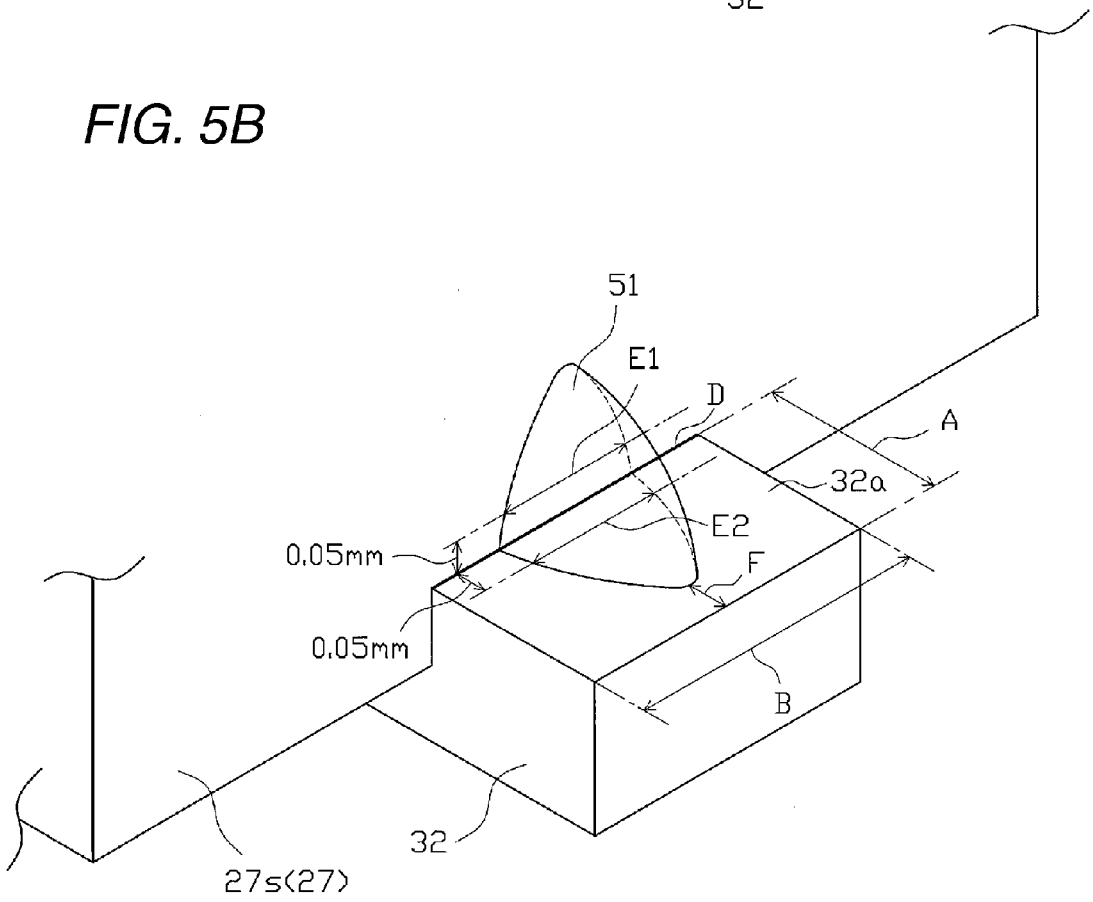
FIG. 5B is a partial perspective view illustrating a bulge portion and other elements.

Additionally, in the present embodiment, the relationship $F \geqq 0.1\ G$ is satisfied where F (mm) is the distance between a protruding end of the bulge portion in the protruding direction and the protruding end surface of the noble metal tip 32, and G (mm) is the shortest distance of the spark discharge gap 33 (see FIG. 3). This dimensional feature suppresses spark discharge between the bulge portion 51 and the noble metal tip 31 for the center electrode. Additionally, the relationship $H \geqq 1.05 \times G$ is satisfied where H (mm) is the shortest distance between the noble metal tip 32 and the molten bond 41 (see FIG. 3). As a result, the sparking rate is reduced between the molten bond 41 and the noble metal tip 32.

Additionally, surface 32*a* of the noble metal tip 32 on the leading end side in the direction of the axis line CL1 is located farther to the leading end side (the upper side of FIG. 3) than the leading end surface of the noble metal tip 31 for the center electrode (in other words, the bulge portion 51 is located farther to the leading end side than the leading end surface of the noble metal tip 31 for the center electrode). This structural feature suppresses spark discharge between the bulge portion 51 and the noble metal tip 31 for the center electrode. Still additionally, the width B of the noble metal tip 32 is greater than the diameter Z of the noble metal tip 31 for the center electrode. This makes it possible to more reliably achieve normal spark discharge between the noble metal tip 31 for the center electrode and the noble metal tip 32.

Next, is a description of a method of producing the spark plug 1 while focusing on a process of producing the ground electrode 27 and the like. First, the metal shell 3 is preprocessed. In more detail, a cylindrical metallic material (for example, a stainless material or an iron-based material such as S15C or S25C) is subjected to cold forging so as to form a through-hole, to thereby form an outline of the metal shell.

Thereafter, the resulting material is subjected to a cutting process so as to adjust the outline, thus obtaining a metal shell intermediate body.

On the other hand, a semi-finished material for the ground electrode 27 is produced. That is, the semi-finished material for the ground electrode 27 is a rod-shaped material that has not yet been bent. For example, a ground electrode 27 that has not yet been bent can be obtained as follows.

In detail, a core containing a metallic material used for the inner layer 27A and a bottomed cylinder containing a metallic material used for the outer layer 27B are prepared (both not shown). Thereafter, a cup material is formed by fitting the core to a concave part of the bottomed cylinder. Thereafter, the cup material having the two-layer structure is subjected to a cold thinning process. For example, a wire drawing process using a die or the like or an extrusion molding process using a female die or the like can be mentioned as the cold thinning process. Thereafter, the resulting material is subjected, for example, to a swaging process, and, as a result, a rod-shaped product reduced diameter is formed.

Thereafter, the ground electrode 27 (rod-shaped product) that has not yet been bent and that has not yet been attached to a tip is joined to the leading end surface of the metal shell intermediate body by resistance-welding. Since a so-called "sag" is generated upon resistance welding, an operation to remove the "sag" is performed. In this example, after performing the swaging process, the cutting process, etc., the ground electrode 27 that has not yet been bent is joined by resistance-welding. However, after performing the thinning process, the rod-shaped product may be joined to the metal shell intermediate body. Thereafter, the swaging process may be performed, and then the cutting process may be performed. If so, when the swaging process is performed, the rod-shaped product joined to the leading end surface of the metal shell intermediate body can be introduced from the leading end side into a processing part (swaging die) of a swager in the state of holding the metal shell intermediate body. Therefore, it becomes unnecessary to purposely set the rod-shaped product to a longer length in order to secure a part used for holding when the swaging process is performed.

Thereafter, the threaded portion 15 is formed at a predetermined portion of the metal shell intermediate body by threading. As a result, the metal shell 3 to which the ground electrode 27 (before being bent) is welded is obtained. The metal shell 3 and the other elements are subjected to galvanizing or nickeling. To improve corrosion resistance, the surface of the metal shell 3 may be further subjected to chromating.

On the other hand, the noble metal tip 32 is formed as mentioned above, and the noble metal tip 32 is joined to the ground electrode 27 by resistance-welding. At this time, the noble metal tip 32 is subjected to resistance welding while being pressed against a flat surface (lower end surface in FIG. 2) of the ground electrode 27 without forming a notch groove or the like in the ground electrode 27. The noble metal tip 32 is embedded in the flat surface of the ground electrode 27 a length of 0.3 mm or more. The bulge portion 51 is formed from a nickel alloy, which is a structural component of the outer layer 27B of the ground electrode 27, so as to jut outside the boundary D upon resistance welding. To perform welding more reliably, any plating present is removed from the welded part prior to the welding operation, or the part to be welded is masked during the plating process. Additionally, the noble metal tip 32 may be welded after performing an attaching operation described below.

On the other hand, the insulator 2 is molded independently of the metal shell 3. For example, a base granulation material for molding is prepared using a raw powder containing alumina as a main component and a binder, and rubber press molding is performed to obtain a cylindrical mold. The resulting mold is ground and shaped. Thereafter, the shaped mold is placed into a baking furnace and is baked, and, as a result, the insulator 2 is obtained.

The center electrode 5 is produced independently of the metal shell 3 and the insulator 2. In detail, a Ni-based alloy is forged, and a copper core is disposed at the middle of the Ni-based alloy in order to improve heat radiation. Thereafter, the noble metal tip 31 for the center electrode as described above is joined to the leading end portion of the center electrode by laser beam welding or the like.

The center electrode 5 thus obtained to which the noble metal tip 31 for the center electrode is joined and the terminal electrode 6 are airtightly fixed to the axial hole 4 of the insulator 2 by means of a glass seal (not shown). Generally, a seal formed by mixing and preparing borosilicate glass and metal powder is used as the glass seal. Thereafter, the center electrode 5 is inserted into the axial hole 4 of the insulator 2, the prepared sealant is then put into the axial hole 4 of the insulator 2, the terminal electrode 6 is then pressed from the rear, and this assembly is baked in a furnace. At this time, a glaze layer may be baked at the same time on the surface of the barrel portion on the base end side of the insulator 2, or a glaze layer may be formed beforehand.

Thereafter, the insulator 2 having the center electrode 5 and the terminal electrode 6 structured as above, respectively, and the metal shell 3 having the straight rod-shaped ground electrode 27 structured as above are assembled. In more detail, the base end portion of the metal shell 3 formed to be comparatively thin is subjected to cold crimping or hot crimping, and hence is held such that a part of the insulator 2 is surrounded by the metal shell 3 from the circumferential direction.

Finally, the straight rod-shaped ground electrode 27 is bent, and a process of adjusting the spark discharge gap 33 between the noble metal tip 31 for the center electrode and the noble metal tip 32 is performed.

The spark plug 1 structured as above is produced by following these series of steps.

As described in detail above, according to the present embodiment, the prism-shaped noble metal tip 32 protrudes from the distal end surface 27*s* of the ground electrode 27 toward the axis line CL1, and the relationship $A \geqq 0.25$ mm is satisfied where A (mm) is the protruding length therefrom. As a result, spark wear resistance as well as ignitability and spark propagation capability can be improved.

On the other hand, since the prism-shaped noble metal tip 32 is formed to satisfy the relationship $A \geqq 0.25$ mm, there is a concern that the tip may be subject to peel-off (falling off of the tip) resulting from the formation of an oxide scale. In view of the above, in the present embodiment, the bulge portion 51 containing the same nickel alloy as the outer layer 27B of the ground electrode 27 is provided at the boundary D extending in the width direction between the noble metal tip 32 and the distal end surface 27*s* of the ground electrode 27 so as to cover at least a center part of the noble metal tip 32. Additionally, the bulge portion 51 has a sufficient volume and width. Therefore, the bulge portion 51 functions as a barrier against oxygen invasion, to thereby control formation of the oxide scale. The bulge portion 51 further functions as a stress reducing layer. As a result of the synergistic effect of these functions, the peel resistance of the noble metal tip 32 is effectively increased.

To confirm the above described effects, various samples were formed, and various evaluations were made by changing the protruding length "A" or by modifying the bulge portion 51. The experimental results are given below.

Figure 9:
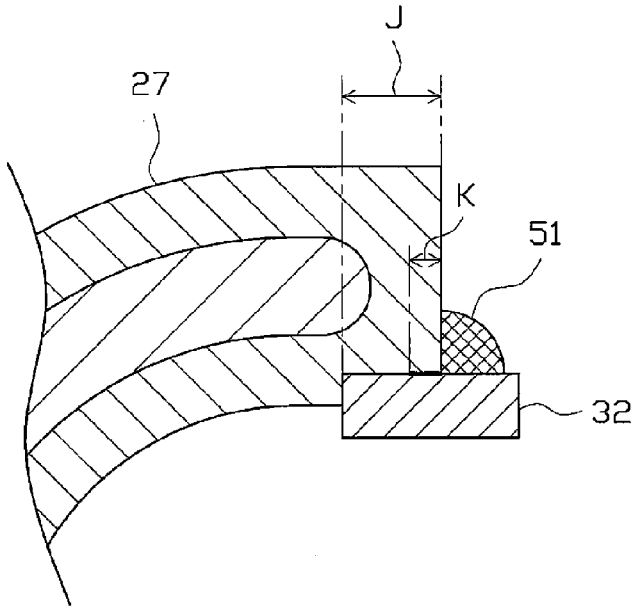
FIG. 9 is a cross-sectional schematic view illustrating the concept of the length of the oxide scale, etc.

As a first experiment, samples having a variously changed protruding length "A" were prepared, and the extent of progress of the oxide scale was evaluated. In more detail, ground electrode samples having variously different protruding lengths "A" were prepared, a desk burner evaluation test (a test in which a process of heating the sample by a burner for two minutes so that the temperature of the tip at its distal end reaches 1100° C. and then slowly cooling the sample for one minute was adopted as one cycle, and 1000 cycles are repeatedly performed) was then carried out, the cross-section of the sample subjected to the test was then observed, and the ratio of the length K of the resulting oxide scale (see the schematic view of FIG. 9) to the length J of an interface area between the ground electrode 27 and the noble metal tip 32 (also see the schematic view of FIG. 9) was evaluated. Herein, an oxide scale ratio exceeding 50% is regarded as a peeling limit. The test results are shown in FIG. 6.

Figure 6:
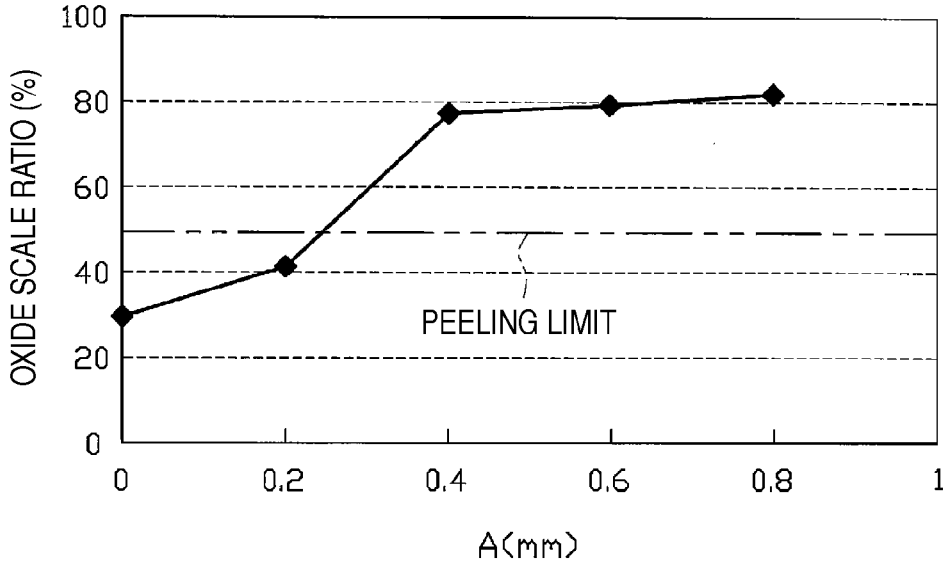
FIG. 6 is a graph showing the relationship of an oxide scale ratio to a protrusion amount.

As shown in FIG. 6, if the protruding length "A" of the noble metal tip is 0.25 mm or more, the oxide scale ratio exceeds 50%, and hence the peeling limit is reached. In other words, if the protruding length "A" is set to 0.25 mm or more to thereby improve ignitability or spark propagation capability, peel-off (falling-off of the tip) resulting from the formation of oxide scale is more likely to occur.

Figure 7:
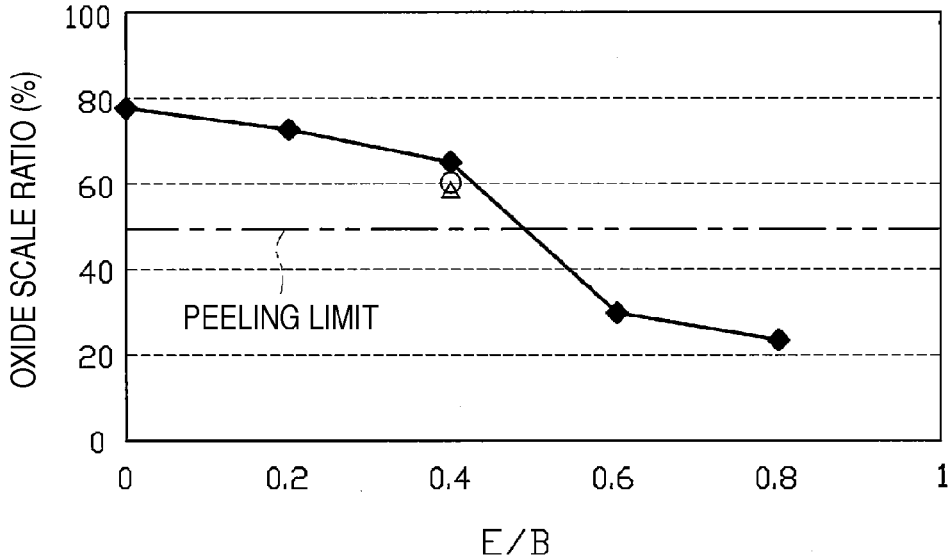
FIG. 7 is a graph showing the relationship of an oxide scale ratio to E/B.

Thereafter, as a second experiment, samples in which the value E/B was variously changed were made where B (mm) is the width of the noble metal tip, E1 (mm) is the length of the bulge portion on a line extending in the width direction and deviating by 0.05 mm from the boundary in the axial direction, E2 (mm) is the length of the bulge portion on a line extending in the width direction and deviating by 0.05 mm in the protruding direction, and E (mm) is the shorter of the lengths E1 and E2. In the same way as in the first experiment, a desk burner test was carried out, and the oxide scale ratio thus obtained was evaluated. The test results are shown in FIG. 7. In FIG. 7, the diamond plot shows the result when E1=E2, the round plot shows the result when E1<E2 (E1/B=0.4, E2/B=0.6), and the triangular plot shows the result when E1>E2 (E1/B=0.6, E2/B=0.4).

As shown in FIG. 7, the oxide scale ratio falls below 50% when E/B is 0.5 or more. That is, the bulge portion has a predetermined volume, and is structured so that the size in the width direction of the bulge portion occupies more than half the width of the noble metal tip even at positions deviating in the axial direction and in the protruding direction, respectively, from the boundary in the width direction. As a result, oxygen invasion is more reliably prevented, and the occurrence of the oxide scale can be effectively controlled. Additionally, by requiring the shorter of the lengths E1 and E2 to meet the relationship E/B≧0.5 when the lengths E1 and E2 are not equal to each other (both in the round plot and in the triangular plot), results corresponding to E/B=0.4 can be obtained.

Finally, as a third experiment, spark plug samples in which the ratio of the distance F to the shortest distance G was variously changed were made where F (mm) is the distance between the protruding end of the bulge portion in the protruding direction and the protruding end surface of the noble metal tip, and G (mm) is the shortest distance of the spark discharge gap, and the incidence rate of sparking (spark discharge) in the bulge portion at that time was measured. The test results are shown in FIG. 8.

Figure 8:
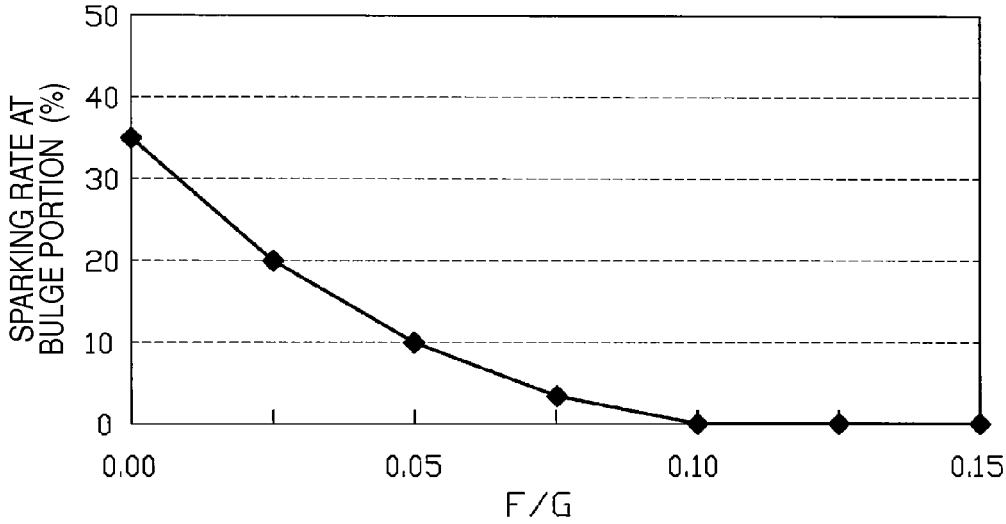
FIG. 8 is a graph showing the relationship of a sparking rate at a bulge rate to F/G.

As shown in FIG. 8, spark discharge is normally carried out without sparking in the bulge portion if the value F/G is 0.10 or more. To the contrary, the incidence rate of sparking in the bulge portion increases if the value F/G falls below 0.10. Accordingly, a structure satisfying the relationship F≧0.1 G restrains spark discharge between the bulge portion 51 and the noble metal tip 31 for the center electrode, and hence prevents peel-off of the noble metal tip 32 for a longer time.

Although the above description was given according to an embodiment of the present invention, the present invention is not limited thereto. It is a matter of course that various modes of carrying out the principles disclosed herein may be adopted without departing from the spirit and scope of the claims appended hereto. For example, the present invention may be embodied as follows.

Figure 10:
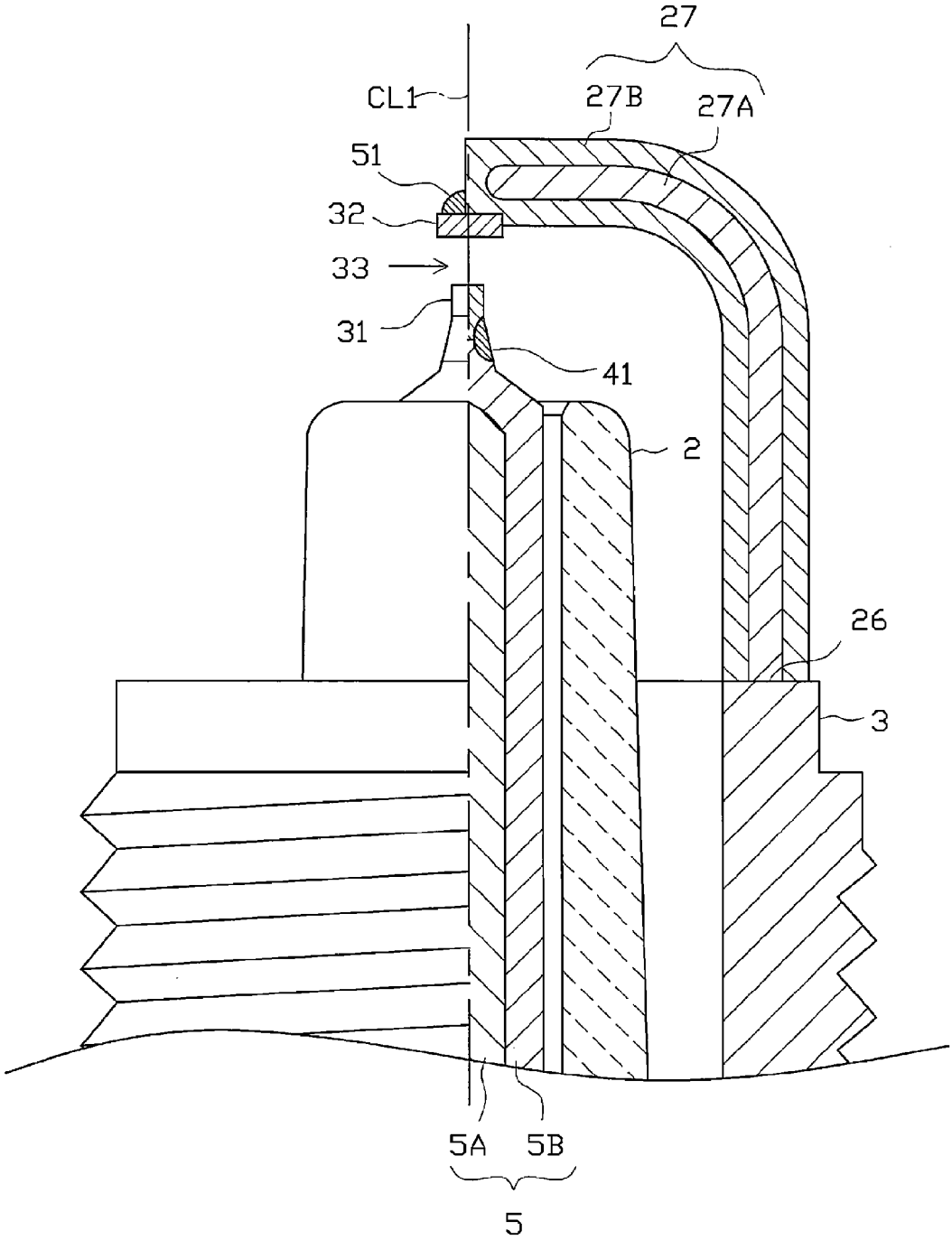
FIG. 10 is a partially enlarged cross-sectional view illustrating a spark plug in another embodiment.

(a) In the above-described embodiment, the noble metal tip 32 protrudes from the distal end surface 27*s* of the ground electrode 27 toward the axis line CL1, and a gap between the outer periphery of the noble metal tip 31 for the center electrode and the noble metal tip 32 defines the spark discharge gap 33. In other words, in the above-mentioned embodiment, spark discharge occurs in a direction substantially perpendicular to the direction of the axis line CL1. In contrast, as shown in FIG. 10, a structure may be adopted in which the end surface in the direction of the axis line CL1 of the noble metal tip 32 (i.e., the lower end surface in FIG. 10) is disposed to face the leading end surface of the noble metal tip 31 for the center electrode (or, alternatively, disposed to face the leading end surface of the center electrode 5). In other words, the spark plug of the present invention may be embodied as a type in which spark discharge occurs substantially in the direction of the axis line CL1.

Figure 11A:
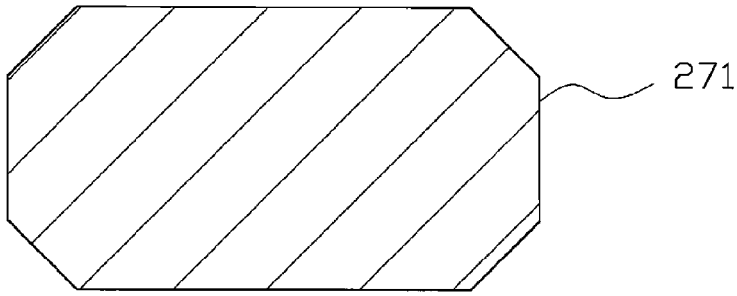
FIG. 11A to FIG. 11C are schematic cross-sectional views of a ground electrode in another embodiment.
Figure 11B:
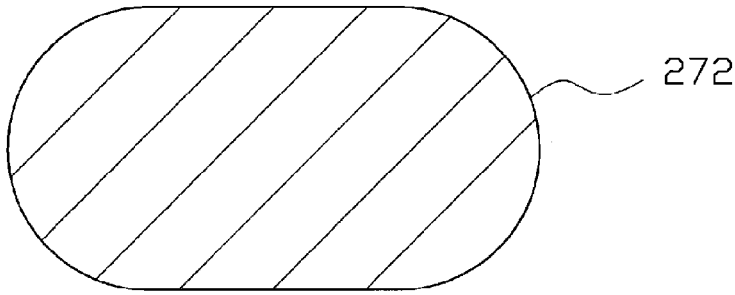
Figure 11C:
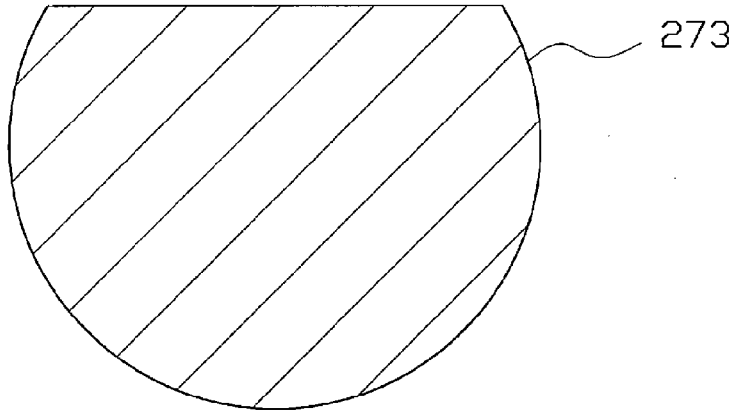

(b) In the above-described embodiment, a ground electrode 27 having a rectangular cross-section is used. However, the shape of the cross-section of the ground electrode 27 is not limited to a rectangular shape. For example, a ground electrode 271 having a polygonal cross-section shape (octagonal shape in FIG. 11A) may be used as shown in FIG. 11A, a ground electrode 272 having an elongated circular cross-section shape may be used as shown in FIG. 11B, a ground electrode 273 having a flat surface obtained by flattening a part of a circular cross-section shape may be used as shown in FIG. 11C, or a ground electrode having an elliptical cross-section shape or a trapezoidal cross-section shape may be used (not shown).

Figure 12:
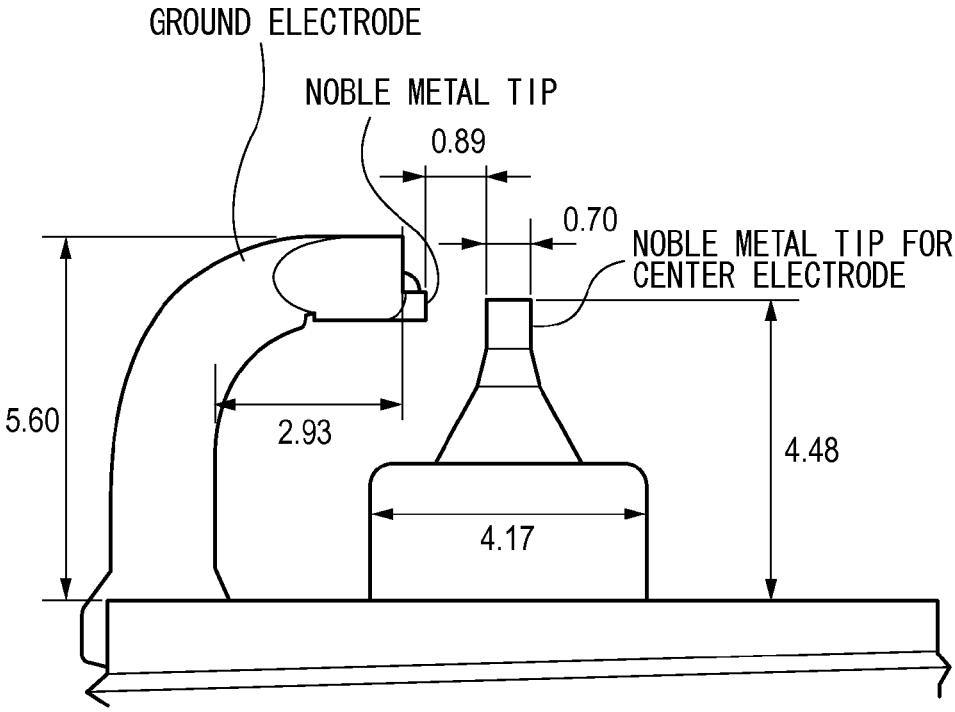
FIG. 12 is a line drawing of a part of the spark plug when viewed from the front.
Figure 13:
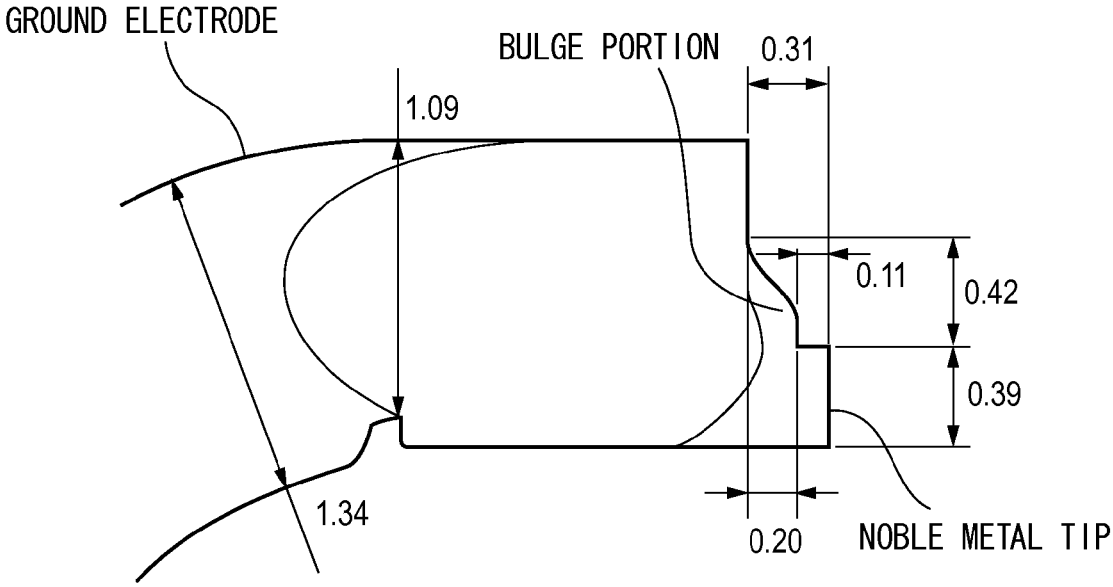
FIG. 13 is a line drawing of the ground electrode and the noble metal tip when viewed from the front.
Figure 14:
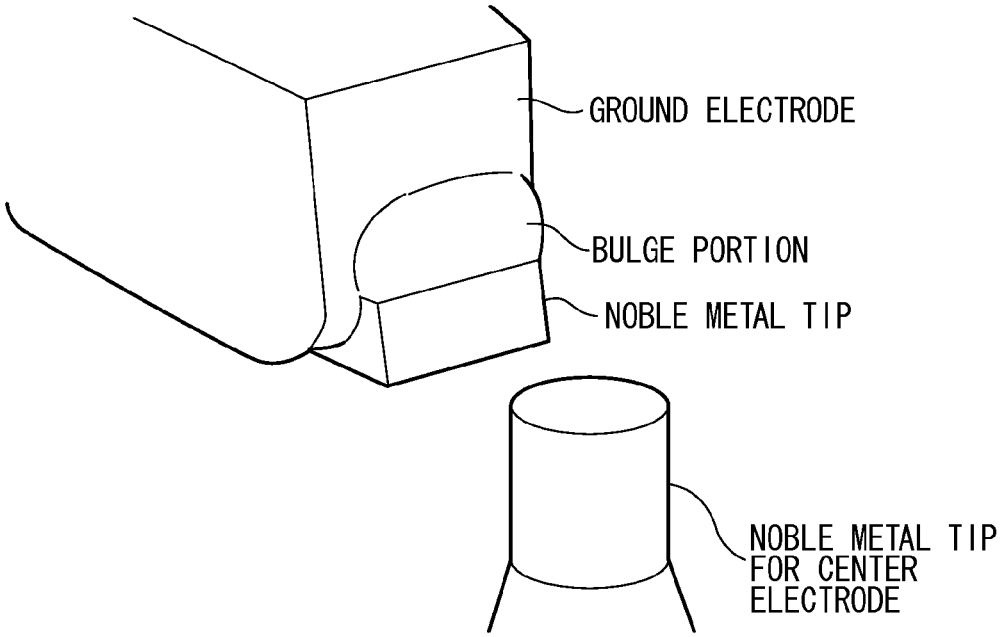
FIG. 14 is a line drawing of the ground electrode, the noble metal tip, and the noble metal tip for the center electrode when viewed from the leading end side.
Figure 15:
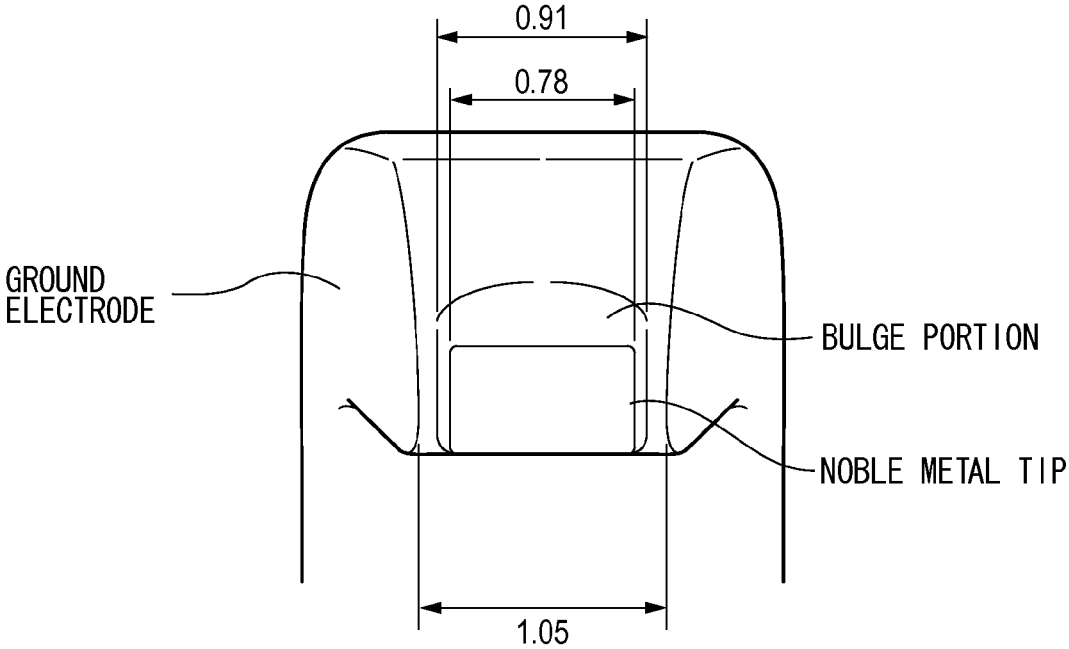
FIG. 15 is a line drawing of the noble metal tip and other elements when viewed from the center-electrode side.
Figure 16:
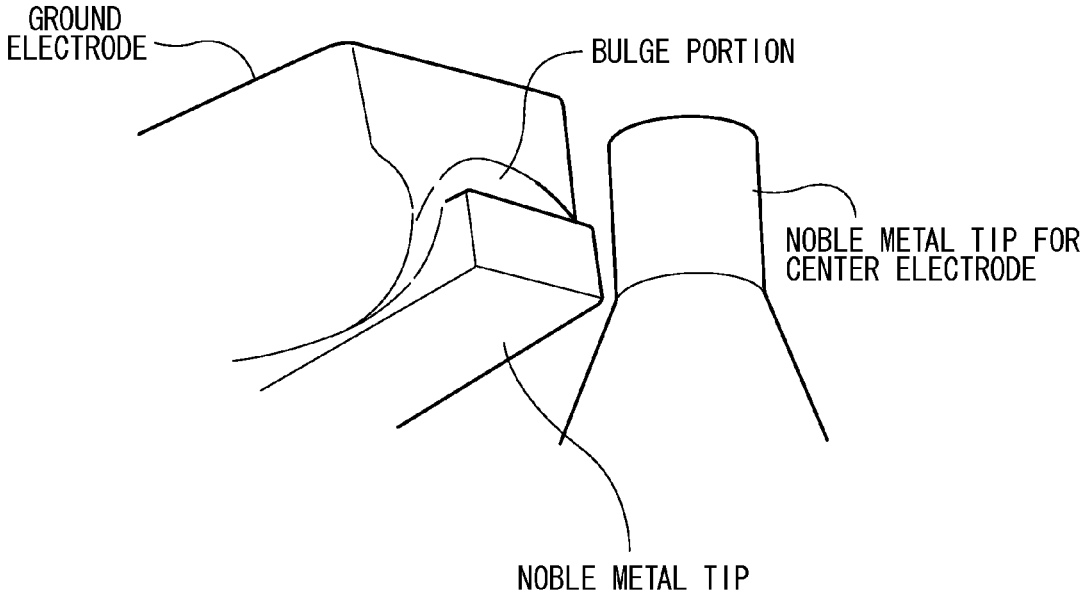
FIG. 16 is a line drawing of the ground electrode, the noble metal tip, and the noble metal tip for the center electrode when viewed from the base end side.

(c) The bulge portion 51 shown in the drawings in the above-described embodiment is depicted schematically. Therefore, the bulge portion can be formed within a range not departing from the gist of the present invention. For example, FIG. 12 is a line drawing of a part of the spark plug when viewed from the front, FIG. 13 is a line drawing of the ground electrode and the noble metal tip when viewed from the front, FIG. 14 is a line drawing of the ground electrode, the noble metal tip, and the noble metal tip for the center electrode when viewed from the leading end side, FIG. 15 is a line drawing of the noble metal tip and other elements when viewed from the center-electrode side, and FIG. 16 is a line drawing of the ground electrode, the noble metal tip, and the noble metal tip for the center electrode when viewed from the base end side.

Figure 17:
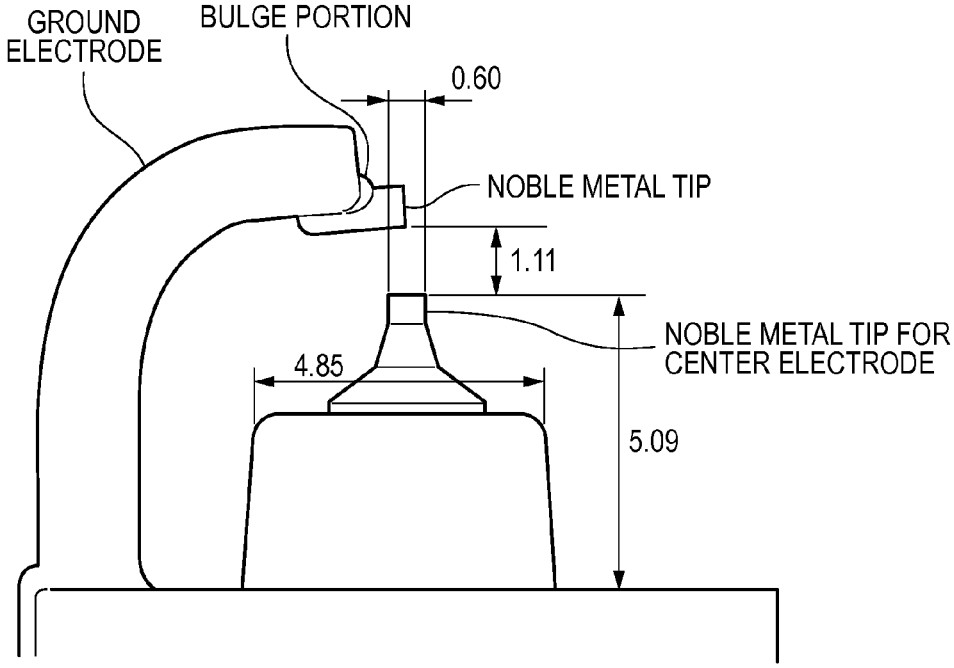
FIG. 17 is a line drawing of a part of the spark plug when viewed from the front.
Figure 18:
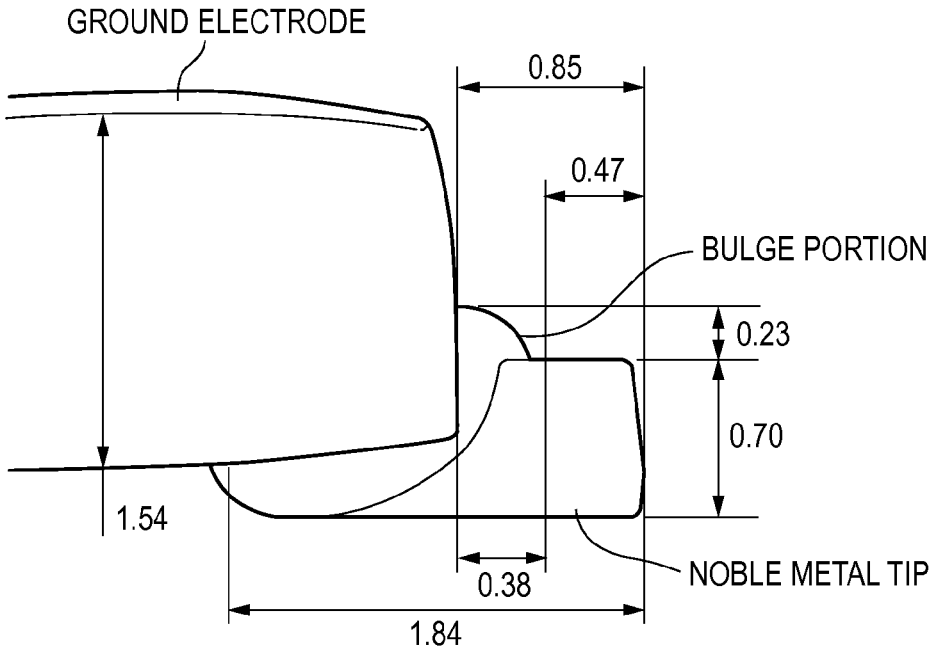
FIG. 18 is a line drawing of the ground electrode and the noble metal tip when viewed from the front.
Figure 19:
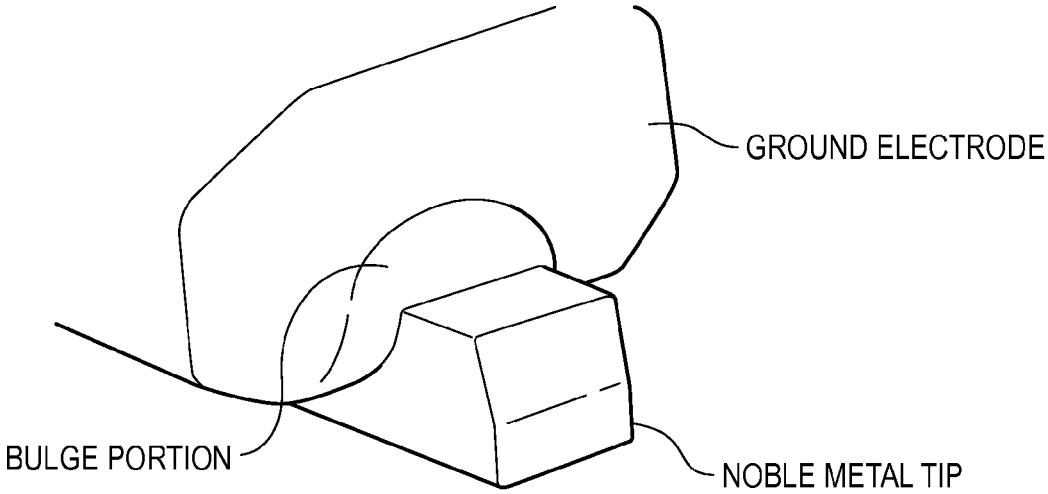
FIG. 19 is a line drawing of the ground electrode and the noble metal tip when viewed from the leading end side.
Figure 20:
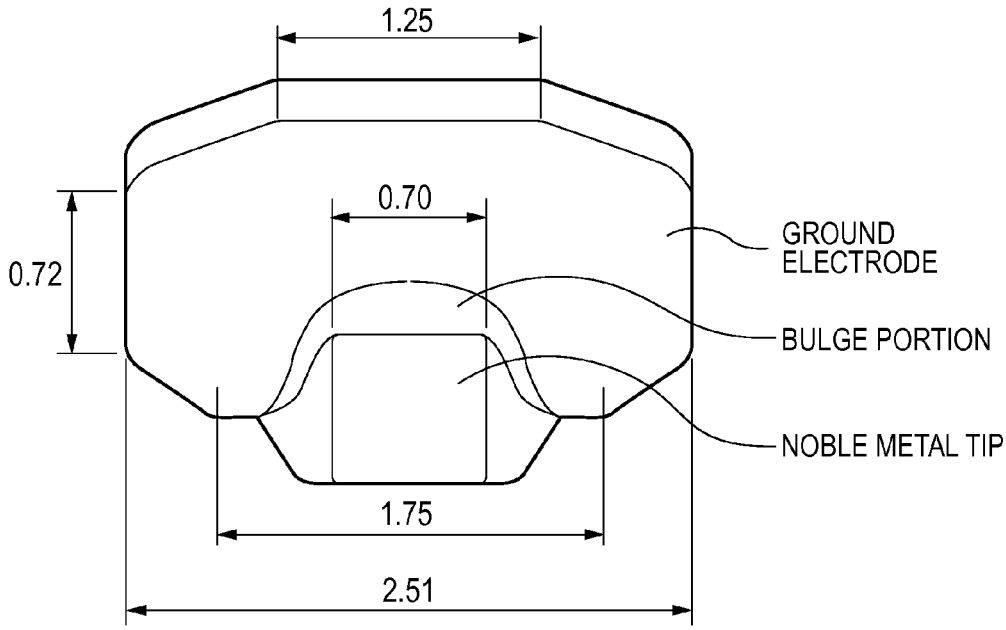
FIG. 20 is a line drawing of the noble metal tip and other elements when viewed from the center-electrode side.
Figure 21:
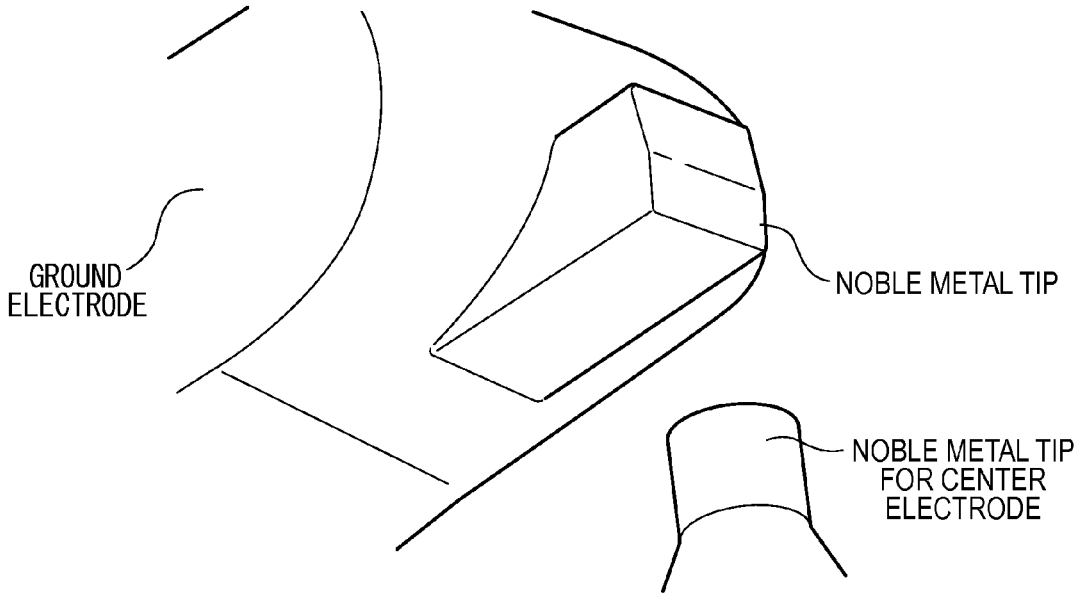
FIG. 21 is a line drawing of the ground electrode, the noble metal tip, and the noble metal tip for the center electrode when viewed from the base end side.

Additionally, line drawings of the spark plug of the type described in the modification (a) and in which a spark discharge is performed substantially in the direction of the axis line CL1 are shown in FIG. 17 to FIG. 21. In detail, FIG. 17 is a line drawing of a part of the spark plug when viewed from the front, FIG. 18 is a line drawing of the ground electrode and the noble metal tip when viewed from the front, FIG. 19 is a line drawing of the ground electrode and the noble metal tip when viewed from the leading end side, FIG. 20 is a line drawing of the noble metal tip and other elements when viewed from the center-electrode side, and FIG. 21 is a line drawing of the ground electrode, the noble metal tip, and the noble metal tip for the center electrode when viewed from the base end side.

Each numerical value in each drawing shows the size of each part, and the unit of each numerical value is given in "mm."

(d) In the above-described embodiment, the noble metal tip 32 is subjected to resistance welding while being pressed against the flat surface of the ground electrode 27 adjacent distal end surface 27*s* without forming a notch groove or the like in the ground electrode 27. A part of the noble metal tip 32 is embedded into the flat surface of the ground electrode 27 a distance of 0.3 mm or more, and the bulge portion 51 is formed by allowing a nickel alloy, which is a structural component of the outer layer 27B of the ground electrode 27, to jut outside the boundary D. In contrast, a notch groove may be formed, and the noble metal tip may be welded so as to bury a part of the noble metal tip therein. Still additionally, the bulge portion 51 may be provided by newly attaching a nickel alloy or the like to the boundary D in a corresponding manner.

(e) In the above-described embodiment, as a material form, the noble metal tip 31 for the center electrode is joined to the leading end of the center electrode 5 by welding. However, a structure in which a noble metal tip 31 for the center electrode is not employed may be adopted.

(f) In the above-described embodiment, for descriptive convenience, the ground electrode 27 is described as merely having a two-layer structure. However, the ground electrode 27 may have a three-layer structure or a multi-layer structure having four or more layers. Preferably, inner layers provided inside the outer layer 27B contain a metal having greater thermal conductivity than the outer layer 27B. For example, an intermediate layer containing a copper alloy or pure copper may be provided inside the outer layer 27B, and an innermost layer containing pure nickel may be provided inside the intermediate layer. Additionally, the ground electrode 27 having only a nickel-made single-layer structure, but not a multi-layer structure, may also be used.

This application is based on Japanese patent Application No. 2007-30082 filed Nov. 20, 2007, the above application incorporated herein by reference in its entirety.

What is claimed is:

1. A spark plug for an internal combustion engine, comprising:

a rod-shaped center electrode extending from a leading end thereof to a base end thereof in an axial direction;

a substantially cylindrical insulator disposed on an outer periphery of the center electrode and extending from a leading end thereof to a base end thereof in the axial direction;

a substantially cylindrical metal shell disposed on an outer periphery of the insulator and extending from a leading end thereof to a base end thereof in the axial direction;

a ground electrode comprising a basal end portion joined to a leading end surface of the metal shell and a distal end portion bent toward the center electrode;

a first noble metal tip joined to the distal end portion of the ground electrode and opposing a leading end portion of the center electrode so as to define a gap, a part of the first noble metal tip being embedded in the ground electrode, and another part of the first noble metal tip protruding in a protruding direction from a distal end surface of the distal end portion of the ground electrode such that a relationship $A \geqq 0.25$ mm is satisfied where A (mm) is the protruding length of the first noble metal tip from the distal end surface of the distal end portion of the ground electrode; and a bulge portion covering at least a center part of an exposed portion of the first noble metal tip in a width direction at a boundary between the first noble metal tip and the distal end surface of the ground electrode, wherein the bulge has a rounded or convex shape, and protrudes in the protruding direction from the distal end surface of the distal end portion of the ground electrode.

2. The spark plug according to claim 1, wherein a relationship $E/B \geqq 0.5$ is satisfied where B (mm) is a width of the first noble metal tip, E1 (mm) is a length of the bulge portion on a line extending in the width direction and deviating by 0.05 mm from the boundary in the axial direction, E2 (mm) is a length of the bulge portion on a line extending in the width direction and deviating by 0.05 mm from the boundary in a protruding direction, and E (mm) is the shorter of the lengths E1 and E2.

3. The spark plug according to claim 1, wherein a protruding end surface of the first noble metal tip in the protruding direction opposes the leading end portion of the center electrode to allow spark discharge in a direction substantially perpendicular to the axial direction.

4. The spark plug according to claim 3, wherein a relationship $F \geqq 0.1$ G is satisfied where F (mm) is a distance between a protruding end of the bulge portion in the protruding direction and the protruding end surface of the first noble metal tip, and G (mm) is a shortest distance of the gap.

5. The spark plug according to claim 3, wherein the center electrode comprises a center electrode main body and a second noble metal tip joined to a leading end portion of the center electrode main body, wherein the center electrode main body and the second noble metal tip are joined to each other via a molten bond in which metallic components of the center electrode main body and the second noble metal tip are fused, wherein the gap is provided between an outer circumferential surface of the second noble metal tip and the protruding end surface of the first noble metal tip, and wherein a relationship $H \geqq 1.05 \times G$ is satisfied where H (mm) is a shortest distance between the first noble metal tip and the molten bond, and G (mm) is a shortest distance of the gap.

6. The spark plug according to claim 1, wherein a base end surface of the first noble metal tip opposes the leading end portion of the center electrode in the axial direction to allow spark discharge substantially in the axial direction.

7. The spark plug according to claim 1, wherein a leading end surface of the first noble metal tip is positioned on a leading end side in the axial direction farther than a leading end of the center electrode.

8. The spark plug according to claim 1, wherein a width of the first noble metal tip is greater than a diameter or a width of the leading end portion of the center electrode.

9. The spark plug according to claim 1, wherein the first noble metal tip has a prism shape.

10. The spark plug according to claim 1, wherein the first noble metal tip is joined to the ground electrode by resistance-welding.

11. The spark plug according to claim 1, wherein the bulge portion contains a metallic material the same as that contained in the ground electrode.

12. The spark plug according to claim 1, wherein the bulge portion is formed from a metallic material originating from the ground electrode.

13. The spark plug according to claim 1, wherein the ground electrode has an outer metallic layer and the bulge portion is formed from metallic material originating from the outer layer of the ground electrode.

14. The spark plug according to claim 1, wherein the bulge portion is formed from a metallic material not originating from the ground electrode.

15. A method for producing the spark plug according to claim 1, said method comprising:

joining the first noble metal tip to the ground electrode by resistance welding while pressing the first noble metal tip against a flat surface of the ground electrode adjacent the distal end surface, such that the noble metal tip is embedded a distance of 0.3 mm or more from the flat surface, thereby forcing a component of the ground electrode to protrude at the boundary and form the bulge portion.

* * * * *